US011786773B2

(12) United States Patent
Gunnarson

(10) Patent No.: US 11,786,773 B2
(45) Date of Patent: Oct. 17, 2023

(54) BRAIDED BELT

(71) Applicant: Landscape Structures Inc., Delano, MN (US)

(72) Inventor: Peter Gunnarson, Rogers, MN (US)

(73) Assignee: Landscape Structures Inc., Delano, MN (US)

( * ) Notice: Subject to any disclaimer, the term of this patent is extended or adjusted under 35 U.S.C. 154(b) by 877 days.

(21) Appl. No.: 16/583,693

(22) Filed: Sep. 26, 2019

(65) Prior Publication Data

US 2020/0254292 A1 Aug. 13, 2020

Related U.S. Application Data

(60) Provisional application No. 62/738,329, filed on Sep. 28, 2018.

(51) Int. Cl.

| | |
|---|---|
| ***A63B 9/00*** | (2006.01) |
| ***E01D 1/00*** | (2006.01) |
| ***D07B 1/00*** | (2006.01) |
| ***D07B 3/00*** | (2006.01) |

(52) U.S. Cl.

CPC ..... *A63B 9/00* (2013.01); *D07B 1/00* (2013.01); *D07B 3/00* (2013.01); *E01D 1/00* (2013.01); *A63B 2009/006* (2013.01); *D07B 2201/1096* (2013.01); *D07B 2501/2069* (2013.01)

(58) Field of Classification Search

CPC .... D07B 1/00; D07B 3/00; D07B 2201/1096; D07B 2501/2069; D01D 15/005; D01D 15/04; D01D 15/133; A63B 9/00; A63B 7/04; E01D 15/005; E01D 15/04; E01D 15/133

See application file for complete search history.

(56) References Cited

U.S. PATENT DOCUMENTS

| | | | | | |
|---|---|---|---|---|---|
| 1,712,017 | A * | 5/1929 | Aoyama | D04C 1/00 | 87/8 |
| 1,815,413 | A * | 7/1931 | Lockwood | E02B 3/26 | 267/140 |
| 2,905,129 | A * | 9/1959 | Denend | E02B 3/26 | 114/219 |
| 3,755,829 | A * | 9/1973 | Walklet | E04H 4/143 | 405/35 |
| 4,048,677 | A * | 9/1977 | Kajlich | E04H 4/143 | 4/497 |
| 5,372,151 | A * | 12/1994 | Kuo | D04D 7/10 | 132/273 |
| 6,817,967 | B1 * | 11/2004 | Ott | A63B 21/4019 | 482/47 |
| D888,168 | S * | 6/2020 | Chiu | D21/684 | |
| 2004/0147378 | A1 * | 7/2004 | Conklin | A63B 21/169 | 482/124 |

(Continued)

*Primary Examiner* — Shaun R Hurley
(74) *Attorney, Agent, or Firm* — Christopher R. Christenson; Kelly, Holt & Christenson, PLLC

(57) ABSTRACT

A braided bridge includes a mounting cable. The braided bridge further includes a first component configured to couple to the mounting cable, where the first spoke component includes one or more spokes and a second spoke component configured to couple to the mounting cable. The one or more spokes of the first spoke component are configured to fold and couple the second spoke component to the first spoke component.

17 Claims, 9 Drawing Sheets

(56) References Cited

U.S. PATENT DOCUMENTS

| | | | | |
|---|---|---|---|---|
| 2007/0129216 | A1* | 6/2007 | Ott | A63B 21/055<br>482/47 |
| 2010/0229960 | A1* | 9/2010 | Merker | F16K 15/20<br>137/223 |
| 2019/0111303 | A1* | 4/2019 | Aihara | A63B 21/02 |

* cited by examiner

BRAIDED BELT

CROSS-REFERENCE TO RELATED APPLICATION

The present application is based on and claims the benefit of U.S. Provisional Patent Application Ser. No. 62/738,329, filed Sep. 28, 2018, the content of which application is hereby incorporated by reference in its entirety.

BACKGROUND

Rope bridges are known and used in many indoor and outdoor settings for a wide range of uses including seafaring, exploration, theatre, construction, and recreation. Rope may consist of one or more groups of fibers or strands twisted or braided together into a larger form. One or more ropes may be joined or braided together to form a rope bridge. A rope bridge may be suspended above the ground with one or more ends of the rope being secured to one or more abutments. For example, a rope bridge may include a rope suspended above the ground stretched between one or more play structures.

SUMMARY

A braided bridge includes a mounting cable. The braided bridge further includes a first spoke component configured to couple to the mounting cable, where the first spoke component includes one or more spokes and a second spoke component configured to couple to the mounting cable. The one or more spokes of the first spoke component are configured to fold and couple the second spoke component to the first spoke component.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solved any or all disadvantages noted in the background.

DETAILED DESCRIPTION

Playground structures require many design considerations. The structures should be safe for users, resilient to user wear, weather resistant, cost effective, easily accessible, resistant to vandalism and theft, and require minimal maintenance.

Given all of the design considerations, playgrounds often include a wide variety of equipment made up of different materials. Braided bridges are one of many pieces of equipment that may be included in a playground. Traditionally, braided bridges are bridges made up of pieces of rope made from natural or synthetic fibers wherein the pieces of rope are joined or braided together and suspended above the ground, whereby the ends of the rope are secured to one or more play structures. Braided bridges are often used in playgrounds for users to walk across, balance on, and/or climb on.

However, it is increasingly desired for braided bridges to be resistant to user wear and be able to withstand weather related elements such as rain, snow, or sun. Therefore, it is desired for braided bridges be constructed such that the bridges are durable, long-lasting, and do not degrade over time.

Figure 1:
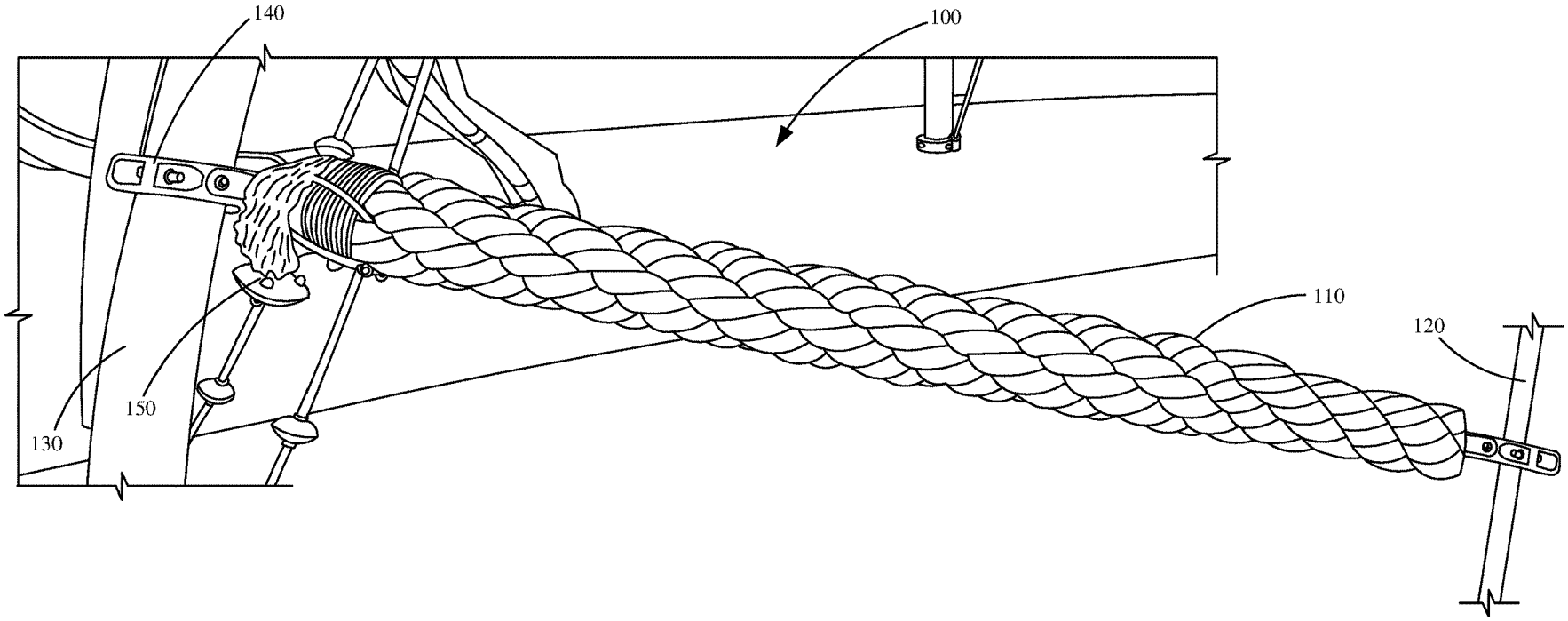
FIG. 1 (Prior Art)
FIG. 1 is a perspective view of a braided bridge known in the prior art.

FIG. 1 is a perspective view of a braided bridge known in the prior art. As shown, braided bridge 100 is coconut rope 110, that is, rope made from the husks of coconuts. Rope 110 is constructed by braiding together multiple strands of coconut rope into a larger rope bridge. Coconut rope 110 is secured to play structures 120, 130 using mounting clamps 140.

Rope 110 has several disadvantages such as being susceptible to rot, degradation, mildew, and being vulnerable to vandalism. Additionally, ends 150 of rope 110 may need to be bound with tape, heat shrink tubing, or other material such as twine to prevent fraying or unravelling of the rope. If ends 150 of rope 110 are not properly bound, rope 110 may fray and degrade over time. Further, rope 110 has the tendency to be highly abrasive making it dangerous for users to use without protective outerwear.

Therefore, it is desired to have a solution that is cost-effective, safe, and durable. This would eliminate or reduce the number of times a braided bridge would need to be replaced and prevent injuries during use. In one example, the braided bridge includes a rubber belting material that is suspended above the ground and secured to two play structures.

Figure 2:
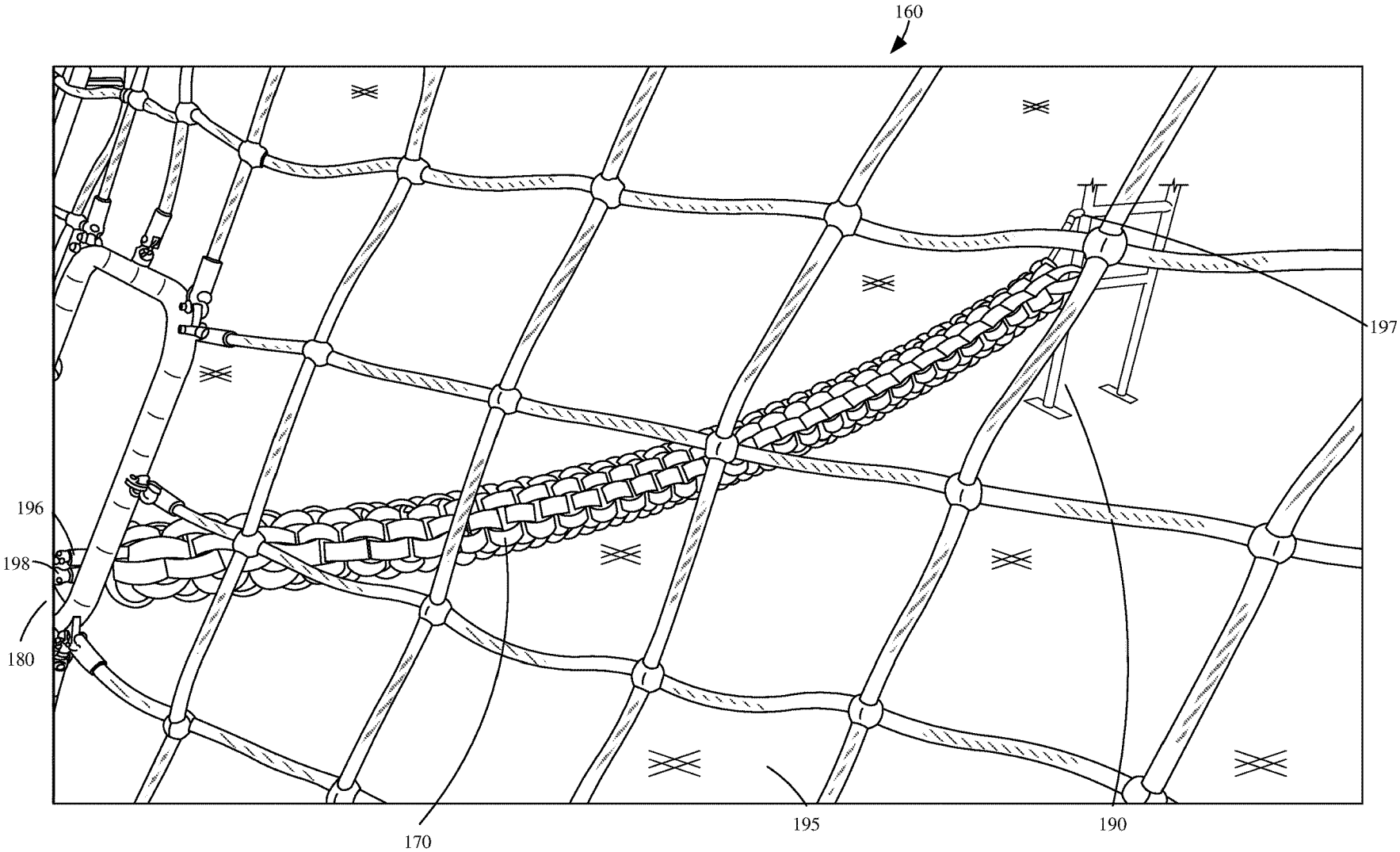
FIG. 2 is a perspective view of a braided bridge in a playground environment.

FIG. 2 is a perspective view of a braided bridge in a playground environment. Playground environment 160 includes braided bridge 170 and play structures 180, 190. As shown, braided bridge 170 is elevated above ground 195 and ends 196, 197 of braided bridge 170 are secured to play structures 180, 190 using mounting cables 198.

Figure 3:
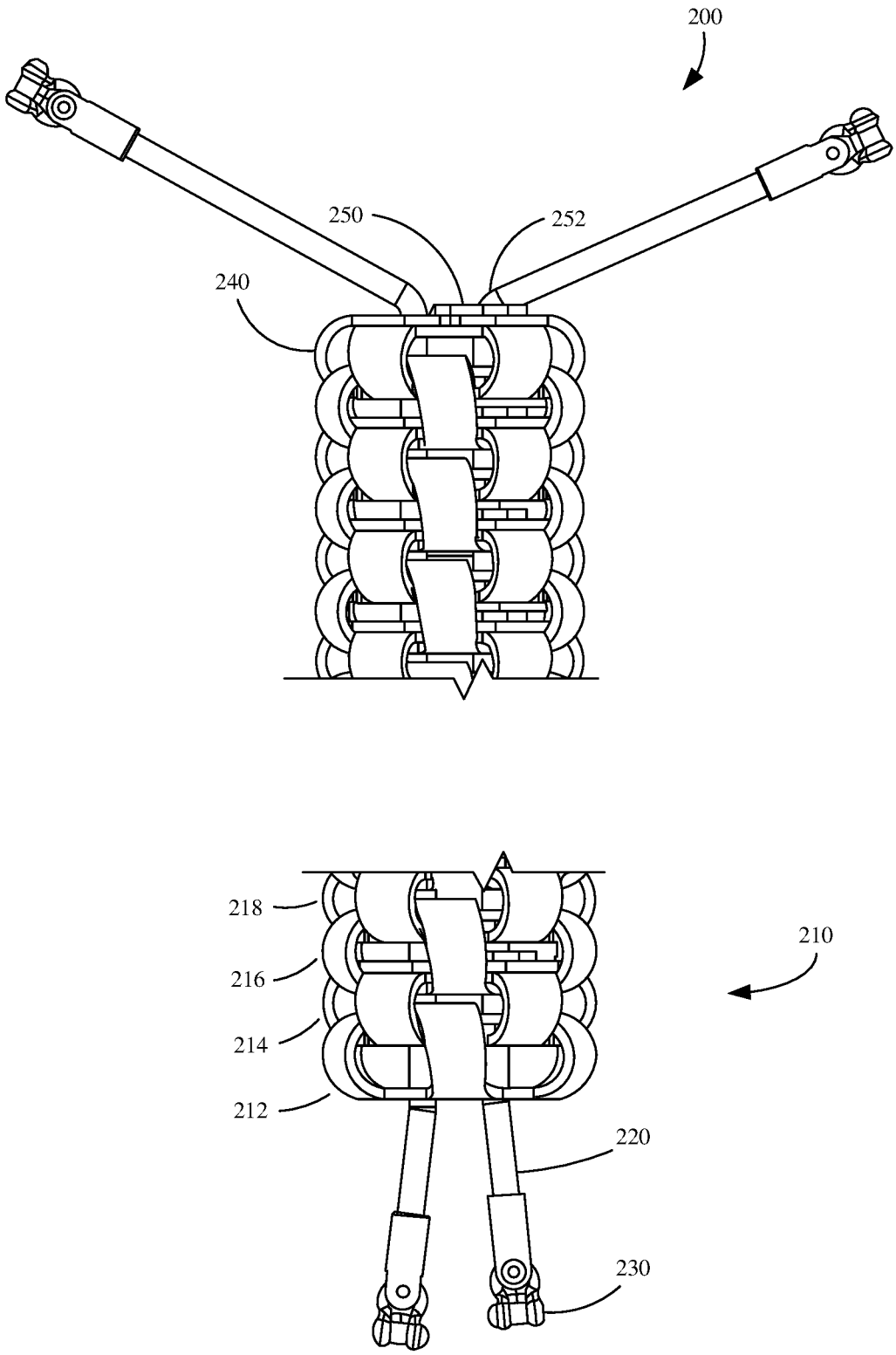
FIG. 3 is a perspective view of a braided bridge.

FIG. 3 is a perspective view of a braided bridge. Shown in FIG. 3 are both ends of braided bridge 200 with the middle of braided bridge 200 removed by a break. As shown, braided bridge 200 includes a plurality of spoke components 210 folded and interconnected about two ropes or cables which are and coupled to mounting cables 220. Braided bridge 200 can extend from one play structure to another (e.g. one playground platform to another). In another example, braided bridge 200 may be mounted independently (e.g. end poles that couple the ends of braided bridge 200 to the ground).

As shown, spoke components 210 are braided together to form braided bridge 200. For instance, a first spoke component 212 wraps around a second spoke component 214, which wraps around a third spoke component 216, which wraps around a fourth spoke component 218, and so on. In other examples, first spoke component 212 can reach further (e.g. to third spoke component 216 or fourth spoke component 218). In some examples spoke components 210 can be braided to one another in other ways as well. Assembly of braided bridge 200 may be completed on site or may be completed before delivery to the install site.

Spoke components 210 can be formed in a variety of different ways. In one example, spoke components 210 may include a belting material that is water jet cut from a larger belt. In one example, spoke components 210 may be die cut from a belt structure. In other examples, spoke components 210 may be cut or formed in different ways. As shown, braided bridge 200 comprises a belting material. In one example, the belting material comprises rubber. In other examples, the belting material can comprise a material other than rubber. In some examples, the belting material can be re-enforced with materials such as steel, cotton, polyamide, polyester, or aramid fibers such as Kevlar. In other examples, the spoke component belting material may be textured. Additionally, in other examples, the belting material may be perforated for easier bending/folding/braiding of spoke components 210. The perforation may also provide a different experience for the user. For instance, a perforated bridge may be more flexible and/or stretch.

Belting materials, such as rubber, provide several benefits. Rubber material is not only durable, low maintenance, and cost-effective but provides essential slip-resistant properties making it safe for users to climb on, walk on, or hold on to even in the rain. Also, the slip-resistant properties of rubber are maintained over time even through use and wear.

Mounting cables 220 may be used to secure braided bridge 200 to one or more play structures. In one example, mounting cables 220 are attached to a play structure using a clevis connection 230 which attaches to a flange on the play structure. In other examples, mounting cables 220 can be connected to other components in different ways as well.

Mounting cables 220 may be spread to varying lengths. As shown in FIG. 3, mounting cables 220 are spread wide at the end of braided bridge 200. Spreading mounting cables 220 wide at the end of braided bridge 200 prevents bridge 200 from rotating about its center axis and can prevent the last spoke component (e.g. component 240) from "unfolding." In other examples, center mounting apertures 250, 252 of braided bridge 200 may be wider spread to allow for less rotation of braided bridge 200. In another example, center mounting apertures 250, 252 are located closer together or there is only one aperture to allow braided bridge 200 to rotate.

Figure 4C:
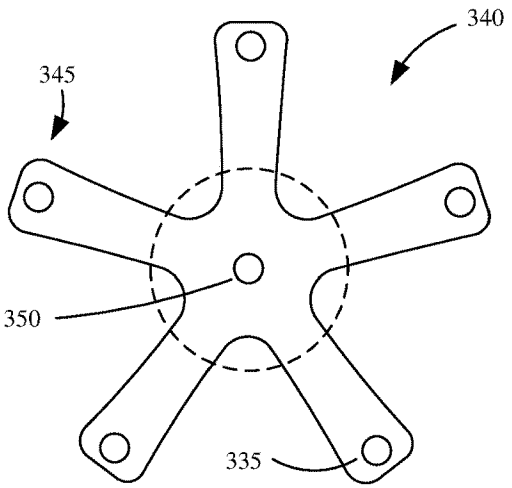
FIGS. 4A-4C are top plan views showing example spoke components of a braided bridge.
Figure 4B:
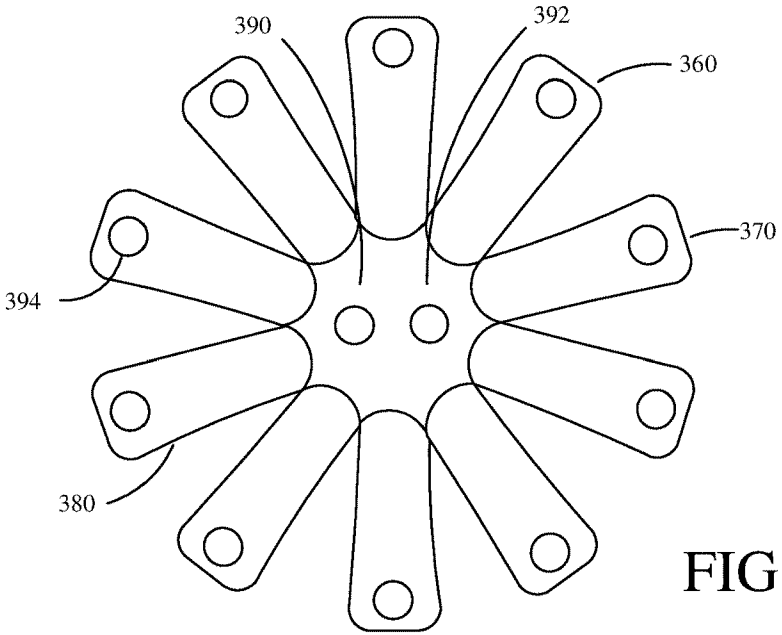
Figure 4A:
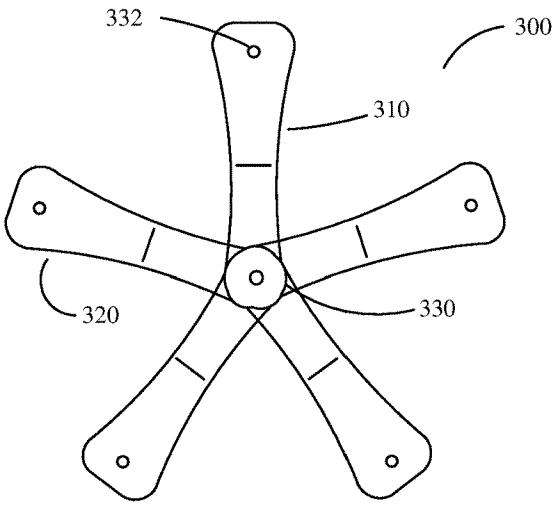

FIG. 4A is a top plan view showing an example spoke component of a braided bridge. Spoke component 300 includes individual spokes 310, 320. As shown, there are five spokes 320 to spoke component 300, however, in other examples, there may be greater or fewer spokes to create spoke component 300. For instance, as shown there are five spokes and five individual parts, however, in other examples each part may have more than one spoke. As shown, spoke component 300 includes five spokes 320, in other examples spoke component 300 may include fewer or greater numbers of spokes (e.g. three or six). Spoke component 300 includes a single center mounting aperture 330, however in other examples there may be more than one mounting aperture 330. Mounting aperture 330 is used to mount spoke component 300 to a cable or rope. Spoke component 300 also shows a single peripheral aperture 332 on each spoke 320, however in other examples there may be more than one peripheral aperture on each spoke 320. Spokes 320 are bent or folded such that peripheral aperture 332 also receive the mounting rope or cable. In other examples, the mounting device is something other than a rope or cable. For instance, the mounting device could be a chain or other flexible material. In one example, the braided bridge mounts onto a solid structure (e.g. a straight steel pipe). In some examples, the solid structure could be arched or in another shape.

FIG. 4B is a top plan view of an example spoke component of a braided bridge. Spoke component 340 includes a single center mounting aperture 350 and five spokes 345 each having a peripheral aperture 335. Spoke component 340 includes only one center mounting aperture 350 which allows the braided bridge to rotate around a mounting cable or rope. In other examples, there may be greater or fewer numbers of spokes, peripheral apertures and/or center mounting apertures.

FIG. 4C is a top plan view of an example spoke component of a braided bridge. Spoke components 360 and 370 both have five spokes 380, each with one peripheral aperture 394, and both spoke components 360 and 370 have two center mounting apertures 390, 392. Having two or more center mounting apertures allows spokes 380 to be attached to multiple mounting cables in order to prevent or inhibit rotation of the braided bridge around the mounting cable. In other examples, there may be more than two center mounting apertures that can allow for greater stability.

Figure 5:
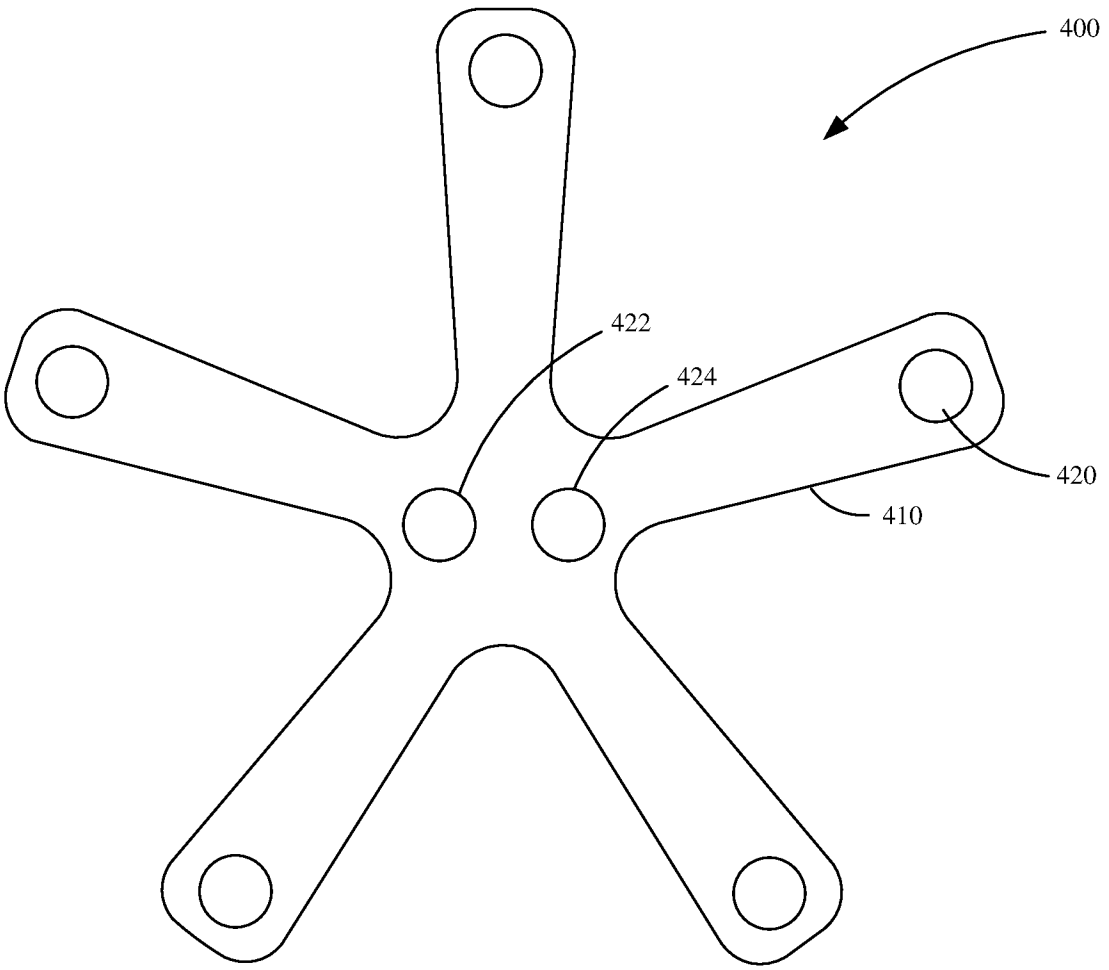
FIG. 5 is a top plan view showing an example spoke component.

FIG. 5 is a top plan view showing an example spoke component. As shown, spoke component 400 includes five spokes 410 wherein each spoke has one peripheral aperture 420 and spoke component 400 has two center mounting apertures 422, 424. As shown, spokes 410 are 72 degrees away from the each other. In other examples, the degree between spokes 410 may be different. This is especially true in embodiments where there are greater or fewer numbers of spokes. Also, as shown, the edges of spokes 410 are defined by an 8 degree angle. In other examples this may be a greater or lesser angle. This angle may be useful in allowing spokes 410 to intertwine over one another with room to spare. Each spoke 410 is roughly 8 inches tall, however in other examples, spokes 410 may be greater or lesser in length. As shown, center mounting apertures 422 and 424 are spaced 2⅛ inches away from each other. In other examples this number distance may be greater or lesser than shown. In some examples, there can be a different number of center mounting apertures. For example, there may be one center mounting aperture that allows the braided bridge to rotate about its mounting cable. In other examples, there may be more than one center mounting aperture that connect to more mounting cables for greater stability of the braided bridge. As shown, each spoke 410 has peripheral aperture 420 that is configured to also attach to the mounting cable by bending or folding spokes 410. In some examples, there may be greater or fewer numbers of peripheral apertures to allow for varying folds of the given spoke. As shown, spokes 410 are all the same length, in some examples, one or more of the spokes are different lengths.

Figure 6:
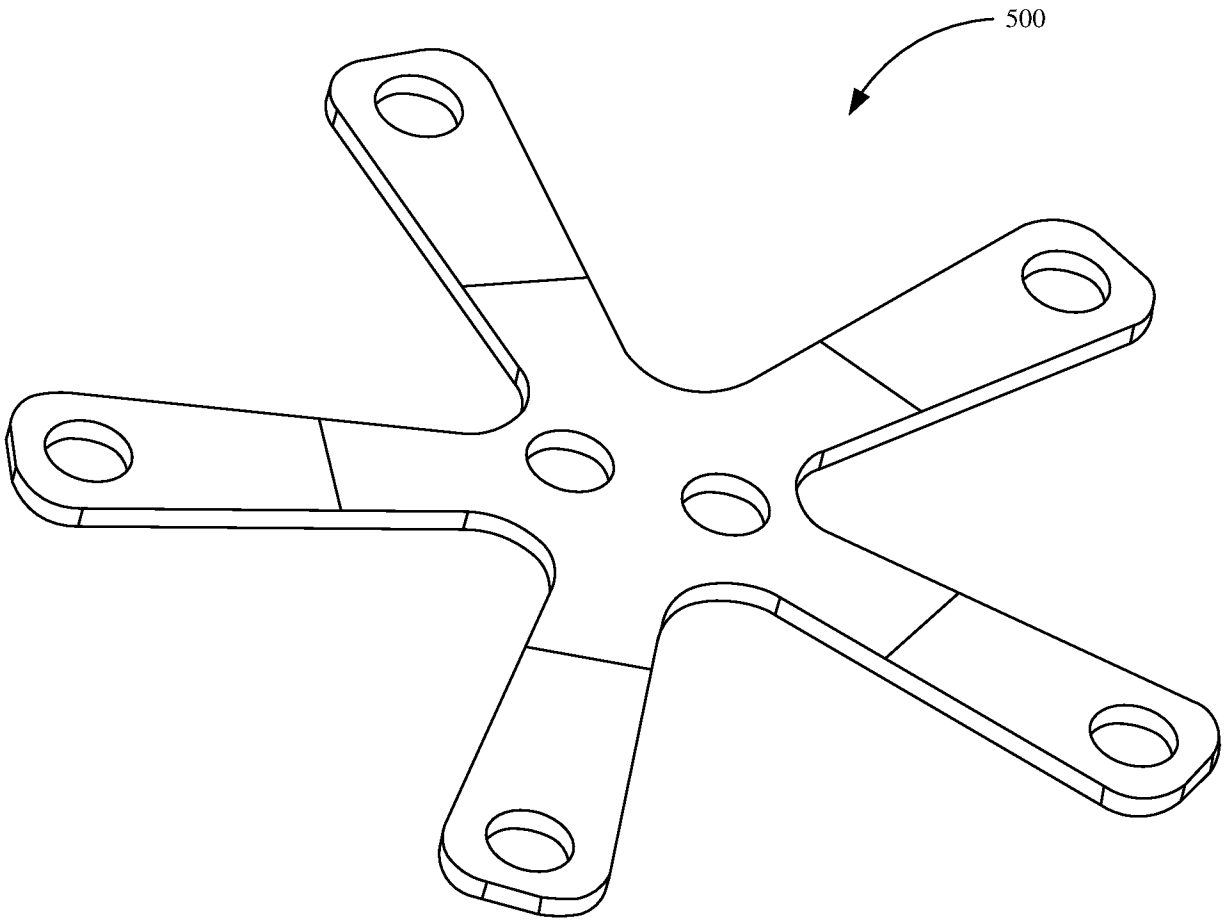
FIG. 6 is a perspective view showing an example spoke component.

FIG. 6 is a perspective view showing an example spoke component 500. As shown, spoke component 500 has a thickness of approximately ½ inch. In other examples, spoke component 500 may be thicker or thinner.

Figure 7:
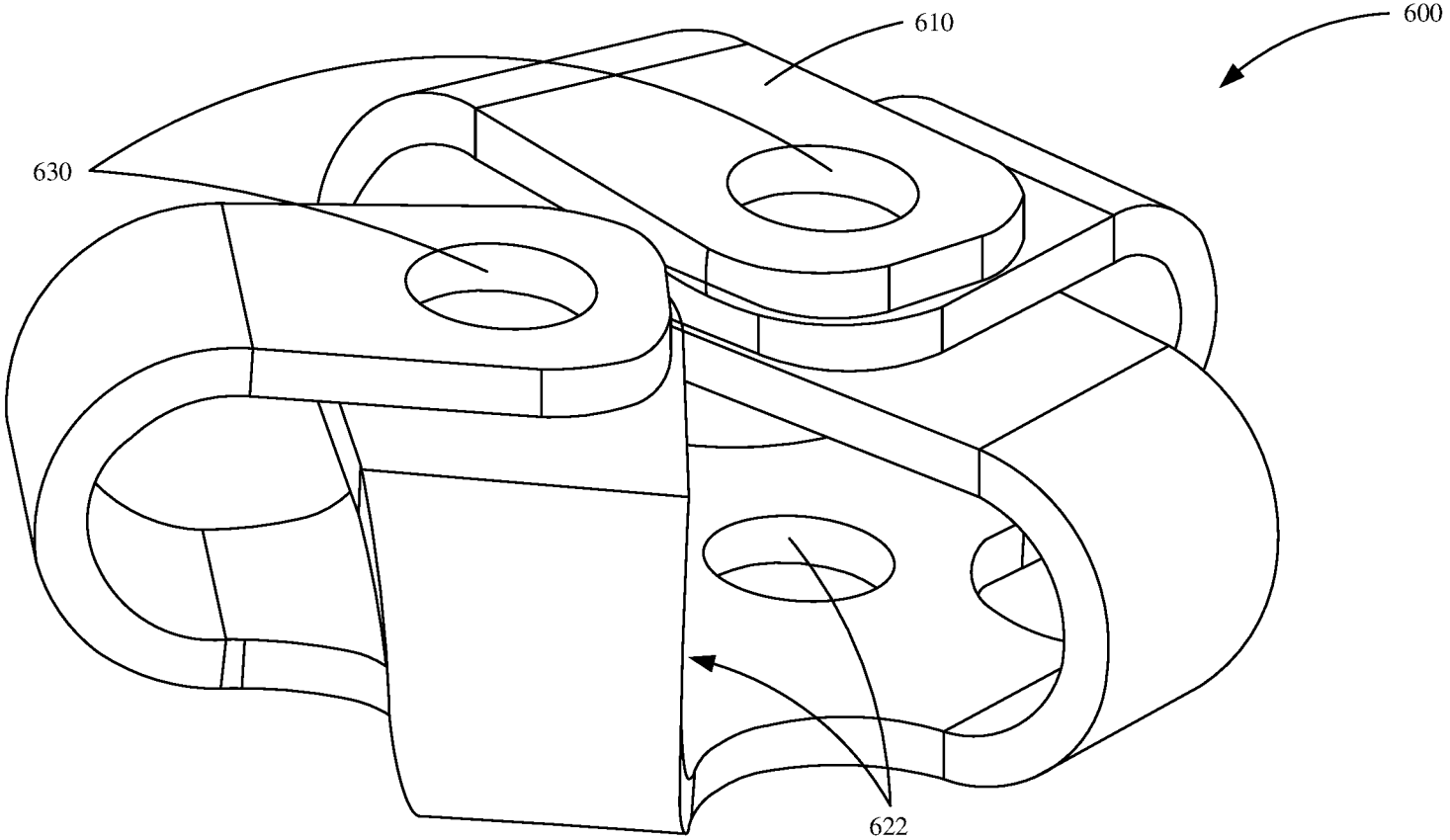
FIG. 7 is a perspective view showing an example folded spoke component.

FIG. 7 is a perspective view showing an example folded spoke component. As shown, spokes 610 of spoke component 600 are folded over upon themselves such that peripheral apertures 630 and center mounting apertures 622 are in alignment. This alignment allows mounting cables (not shown) to extend through all peripheral apertures 630 and center mounting apertures 622 of spoke component 600 and hold them in place. The folding arrangement of FIG. 7 is not the only folding arrangement possible and other folding arrangements may be used.

Figure 8:
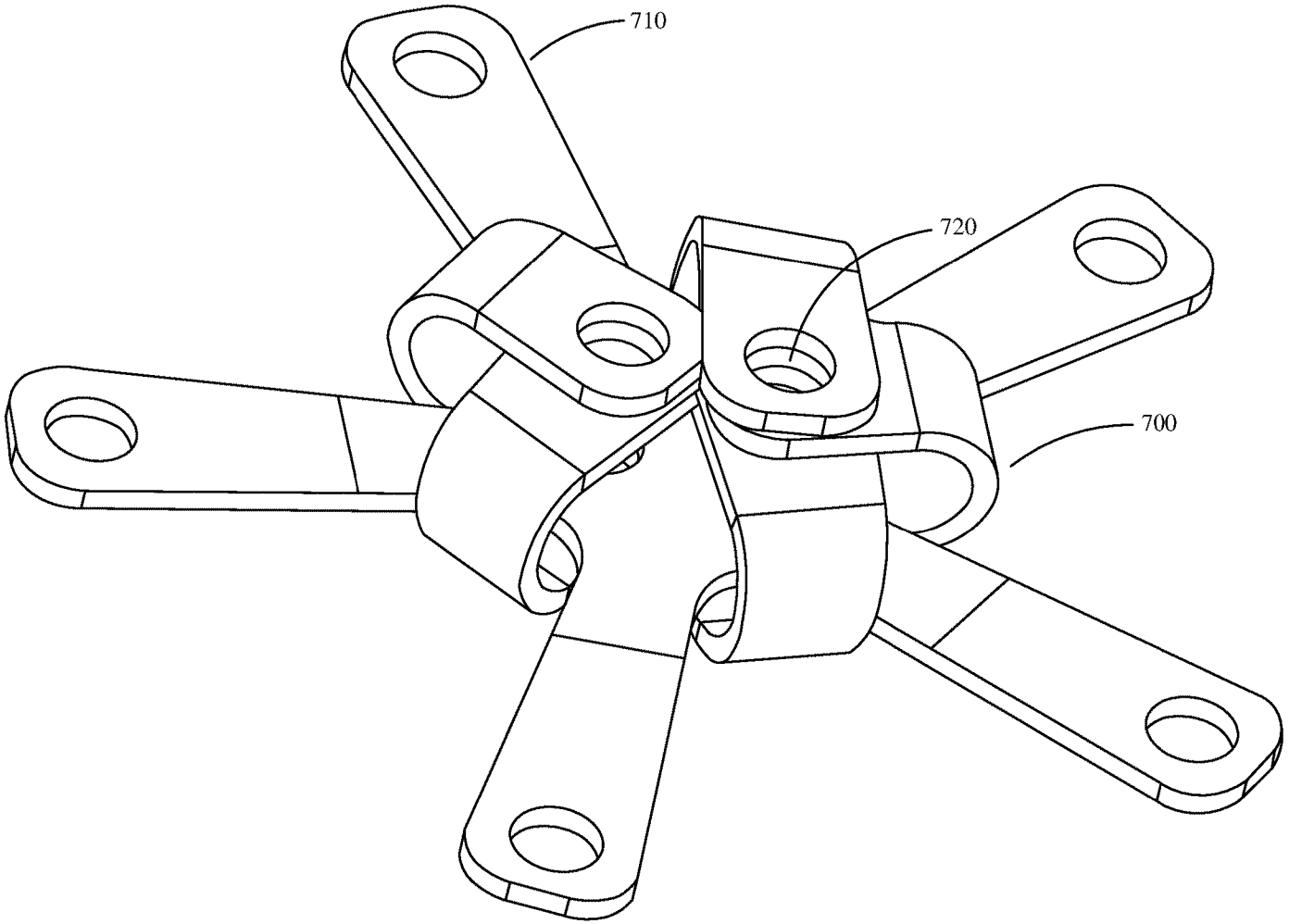
FIG. 8 is a perspective view showing an example partial folding.

FIG. 8 is a perspective view showing an example partial folding assembly. As shown, a first spoke component 700 has been folded about a second spoke component 710. To continue the folding assembly mounting cables would be inserted through aligned apertures 720 of first spoke component 700 and second spoke component 710, as shown. Then a third spoke component (not shown) would be laid on top of, presently folded, first spoke component 700. Second spoke component 710 would be folded on top of the third spoke component to couple the third spoke component in alignment with first spoke component 700 and second spoke component 710. This process would be repeated over and over to assemble a full braided bridge.

Figure 9:
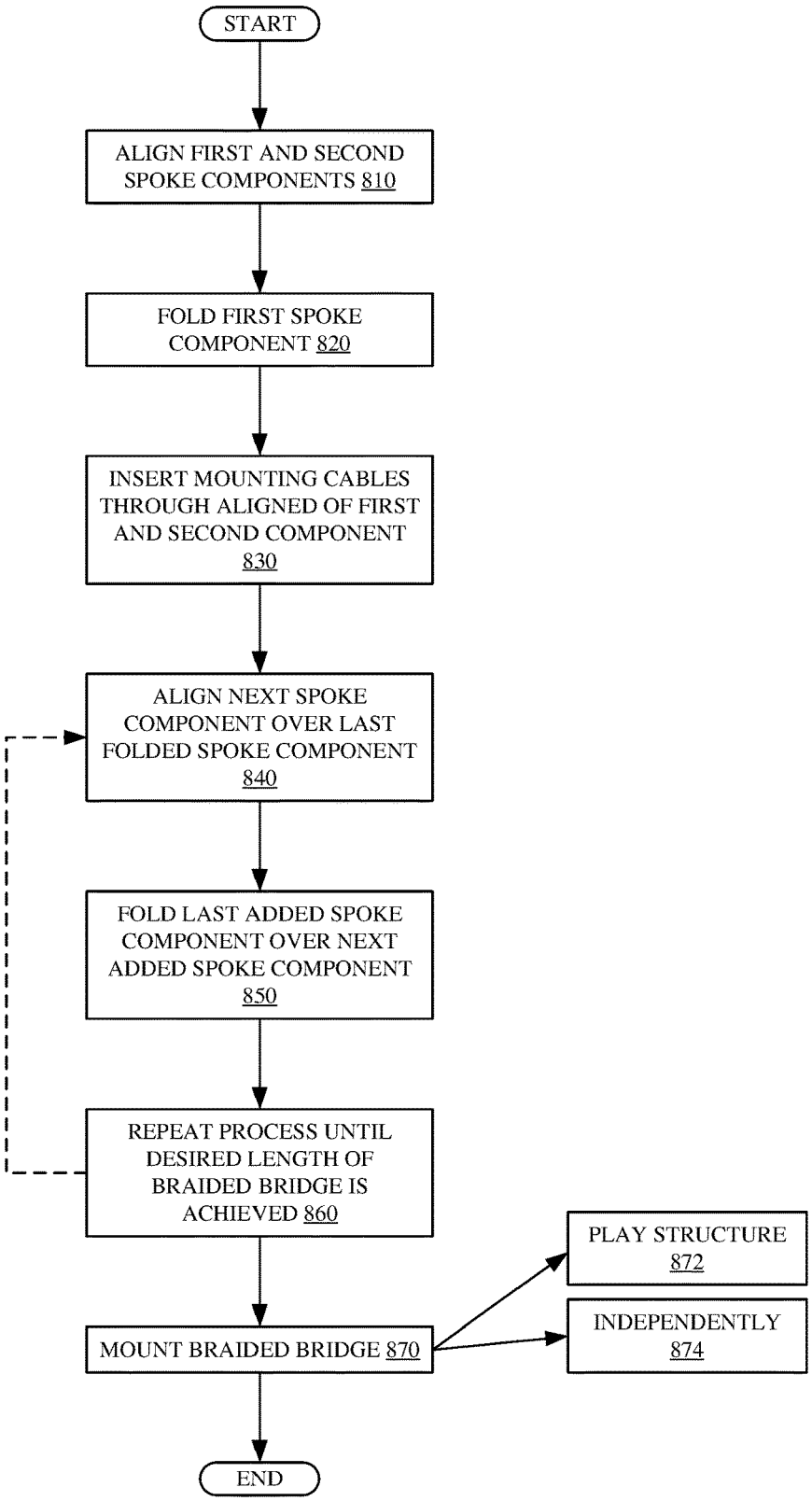
FIG. 9 is a flow diagram showing an example method of creating a braided bridge.

FIG. 9 is a flow diagram showing an example method of assembling a braided bridge. The method may be used to assemble a braided bridge by braiding together individual spoke components. This braided bridge could be used, for example, on playgrounds.

At block 810, a first spoke component and a second spoke component are aligned. In one example, aligning the first and second spoke components includes placing the second spoke component directly on top of the first spoke component such that the center mounting apertures of the first and second spoke component align and rotating the second spoke component such that the spokes of the first component do not overlap with the spokes of the second component. In other examples, the alignment of the first and second spoke components may differ.

At block 820, the first spoke component is folded about the second spoke component. In one example, folding the first spoke component includes bending each individual spoke inward towards the center mounting apertures and overlapping each spoke such that all peripheral apertures on the first spoke component align with the center mounting apertures. In another example, the folding process of the first spoke component may differ.

At block 830, mounting cables are inserted through the aligned center mounting apertures of the first and second spoke component and the aligned peripheral apertures of the first spoke component. In one example, the mounting cables may comprise rope or cable. In other examples, the mounting cables may comprise chains or other flexible material. In some examples, the mounting cables are inserted earlier (e.g. before or after blocks 810 or 820).

At block 840, a next spoke component is placed on top of the last folded spoke component. In one example, the center mounting apertures of the next spoke component are inserted onto the mounting cables and the next spoke component is aligned with the last added spoke component such that the spokes of the next spoke component do not overlap with the spokes of the last added component. In other examples, the alignment of the last added and next spoke components may differ.

At block 850, the spokes of the last added spoke component are folded about the next added spoke component. In one example, folding the last added spoke component includes bending each individual spoke inward towards the center mounting apertures and overlapping each spoke such that all peripheral apertures on the last added spoke component align with the center mounting apertures. In another example, the folding process of the last added spoke component may differ.

At block 860, the alignment and folding process of spoke components is repeated until the desired length of the braided bridge is achieved.

At block 870, the braided bridge is mounted to a play structure. In one example, the braided bridge may be mounted to one or more play structures using clevis connections which attach to the flanges on the play structure, as indicated at block 872. In another example, the braided bridge may be mounted independently, as indicated at block 874.

Although the present invention has been described with reference to preferred embodiments, workers skilled in the art will recognize that changes may be made in form and detail without departing from the spirit and scope of the invention.

What is claimed is:

1. A braided bridge comprising:

a mounting cable;

a first spoke component mounted to the mounting cable, the first spoke component comprising one or more spokes;

a second spoke component mounted to the mounting cable; and wherein the one or more spokes of the first component fold and couple the second spoke component to the first spoke component.

2. The braided bridge of claim 1, wherein the first spoke component and the second spoke component each comprise a center mounting aperture.

3. The braided bridge of claim 2, wherein the braided bridge rotates around the mounting cable.

4. The braided bridge of claim 1, wherein the mounting cable comprises a flexible material.

5. The braided bridge of claim 1, wherein the braided bridge is mounted to a play structure.

6. The braided bridge of claim 1, wherein the first spoke component and the second spoke component each comprise five spokes.

7. The braided bridge of claim 6, wherein each spoke comprises a peripheral aperture configured to receive the mounting cable.

8. The braided bridge of claim 1, and further comprising a second mounting cable.

9. The braided bridge of claim 8, wherein the first spoke component and the second spoke component each comprise two center mounting apertures.

10. A method of assembling a braided bridge, the method comprising:

aligning a first spoke component and a second spoke component wherein the first spoke component and the second spoke component comprise one or more spokes;

folding the first spoke component; and inserting a mounting cable through a center mounting aperture of the first spoke component and the second spoke component.

11. The method of claim 10, wherein the first spoke component and the second spoke component comprise one or more center mounting apertures.

12. The method of claim 10, wherein aligning the first spoke component and the second spoke component comprises placing the second spoke component on top of the first spoke component such that the spokes of the first spoke component and the second spoke component do not overlap.

13. The method of claim 10, wherein the spokes comprise a peripheral aperture.

14. The method of claim 13, wherein folding comprises folding the spokes of the first spoke component such that the peripheral apertures of each spoke align with the center mounting aperture of the first spoke component and the second spoke component.

15. The method of claim 10, and further comprising:

aligning a next spoke component on top of the last folded spoke component such that the center mounting aperture of the next spoke component aligns with the center mounting aperture of the last folded spoke component and the last added spoke component.

16. The method of claim 15, wherein the next spoke component is aligned such that spokes of the next spoke component do not overlap with the spokes of the last added spoke component.

17. The method of claim 15, wherein the next spoke component comprises one or more center mounting apertures.

* * * * *